US007033965B2

(12) United States Patent
Takabayashi et al.

(10) Patent No.: US 7,033,965 B2
(45) Date of Patent: Apr. 25, 2006

(54) CLEANING SHEET

(75) Inventors: Keima Takabayashi, Tochigi (JP); Kazuo Mori, Tochigi (JP); Akihito Shizuno, Tochigi (JP)

(73) Assignee: Kao Corporation, Tokyo (JP)

( * ) Notice: Subject to any disclaimer, the term of this patent is extended or adjusted under 35 U.S.C. 154(b) by 75 days.

(21) Appl. No.: 09/974,853

(22) Filed: Oct. 12, 2001

(65) Prior Publication Data

US 2002/0065012 A1 May 30, 2002

(30) Foreign Application Priority Data

Oct. 13, 2000 (JP) ..... 2000-314336
Jul. 12, 2001 (JP) ..... 2001-212739

(51) Int. Cl.
*B02B 5/26* (2006.01)
*B02B 5/02* (2006.01)
*A47L 13/10* (2006.01)

(52) U.S. Cl. ..... 442/381; 442/389; 442/394; 442/400; 442/149; 442/414; 15/208; 15/209.1; 428/77; 428/192

(58) Field of Classification Search ..... 442/381, 442/389, 394, 400, 149, 414; 15/208, 209.1; 428/77, 192
See application file for complete search history.

(56) References Cited

U.S. PATENT DOCUMENTS 4,186,031 A * 1/1980 Armstrong et al. ..... 134/1
5,377,378 A 1/1995 Cutler

FOREIGN PATENT DOCUMENTS

| | | | |
|---|---|---|---|
| EP | 1 116 472 A1 | | 7/2001 |
| JP | 09-021055 | | 1/1997 |
| JP | 9-21055 | | 1/1997 |
| JP | 9-224895 | | 9/1997 |
| JP | 09-224895 | * | 9/1997 |
| JP | 9-313417 | | 12/1997 |
| JP | 10-5164 A | | 1/1998 |
| JP | 10-060761 | | 3/1998 |
| JP | 10-60761 | | 3/1998 |
| JP | 10-155713 | | 6/1998 |
| JP | 10-262884 | | 10/1998 |
| JP | 11-89775 | | 4/1999 |
| JP | 11-113823 | | 4/1999 |
| JP | 2000-110057 | | 4/2000 |
| JP | 2000-225084 | | 8/2000 |
| JP | 12-328415 | * | 11/2000 |
| JP | 2000-328415 | * | 11/2000 |
| JP | 2001-137169 | | 5/2001 |
| WO | WO 01-80705 A2 | | 1/2001 |
| WO | WO 01/06906 A1 | | 2/2001 |

* cited by examiner

*Primary Examiner*—Norca Torres
(74) *Attorney, Agent, or Firm*—Birch, Stewart, Kolasch & Birch, LLP

(57) ABSTRACT

A cleaning sheet having a cleaning surface comprising a cleaning area for cleaning a piled surface and a low-friction area which adjoins the cleaning area. The cleaning area has a coefficient of static friction of 0.1 to 4.0 against wool press felt (JIS L3201 R33W). The low-friction area comprises a film or nonwoven fabric and has a coefficient of static friction of 0.01 to 1.0 against wool press felt (JIS L3201 R33W).

5 Claims, 3 Drawing Sheets

CLEANING SHEET

BACKGROUND OF THE INVENTION

The present invention relates to a cleaning sheet which exhibits excellent cleaning performance on fluffy surfaces, particularly raised or piled surfaces, such as carpets, rugs, couches, and automotive seats.

JP-A-10-155713 discloses a disposable cleaning article comprising a base layer of a thermoplastic resin, a dust catching layer superposed on the base layer, and a cover layer of a thermoplastic resin having openings through which the dust catching layer is exposed. The dust catching layer is fabricated of a large number of continuous filaments of a thermoplastic resin. The cleaning article is designed to have a plurality of wiping functions so as to eliminate the trouble of using different cleaning articles according to the place to be cleaned. While the cleaning article is fit for cleaning a flat surface such as flooring but incapable of catching up hairs, etc. entangled with a carpet. Hairs, etc. cannot be caught up without applying a large force resistant to the friction. Thus, it is difficult for a cleaning article of this type to have both dust removing properties from a piled surface and operating properties in cleaning operation.

JP-A-2001-137169 discloses a fitting sheet which is removably fitted to a cleaning tool when a cleaning sheet is attached to the cleaning tool. The fitting sheet has been developed for saving the cleaning sheet by minimizing the area of the cleaning sheet to be attached to the cleaning tool and for using the cleaning tool clean. However, the cleaning sheet used in combination with the fitting sheet is spun-laced nonwoven and is incapable of scraping and catching up fibrous dust such as hairs entangled with a carpet.

JP-A-10-60761 proposes a cleaning sheet for collecting dust of small to large sizes, which comprises air-laid nonwoven fabric made of fibers having a fineness of 1.5 to 3 denier and air-laid nonwoven fabric made of fibers having a fineness of 6 to 32 denier, the two kinds of nonwoven fabric being arranged in an arbitrary configuration. This cleaning sheet is for cleaning smooth surfaces such as flooring and is not fit for cleaning piled surfaces such as a carpet.

JP-A-2000-110057 discloses a composite sheet for cleaning a piled surface such as a carpet which is prepared by entangling a web containing thermally shrinkable fiber with a net in three-dimensions and causing the web to shrink by heat treatment thereby to make the net project over the web surface. It is the projecting parts of the net that can enter into pile. Therefore, how deep the projections enter into pile depends on the configuration of the net, and the number of projections that can enter is limited. Considerably stiffer than pile, the projections can damage the pile. Since the net and the web are structurally integral with each other, it is difficult to control them separately. In order for allowing the net to project sufficiently, the fibers constituting the web should have limited freedom, which is unfavorable for making the web hold dust. That is, the sheet cannot be seen as satisfactory in ability to rake up dust and ability to hold the collected dust.

JP-A-9-21055 describes nonwoven composite fabric having short fibers oriented nearly randomly in the surface layer thereof. The nonwoven composite fabric has a controlled fiber composition and a controlled fiber orientation so as to have bulkiness and a satisfactory texture or feel. Therefore, the nonwoven composite fabric does not serve for cleaning a piled surface.

JP-A-10-262884 discloses a wiping sheet having a multilayer structure in which short fiber nonwoven fabric and a net of very thick fiber are superposed on each other. Having an unevenness on the surface, the wiping sheet exhibits both dust raking ability and dust holding ability. Accordingly, it is different in both idea and constitution from the present invention in which dust raking and dust holding are performed by a combination of sheets having the respective functions.

JP-A-2000-225084 proposes a cleaning tool for easily removing hairs, etc. entangled with a carpet which comprises a roller and a scraping sheet which has hooked projections and is wound around the roller. Because the number of the hooked projections that can be formed on the scraping sheet is limited, it is difficult to improve the cleaning performance to remove hairs, etc. Granting the number of the hooked projections could be increased, damage by the hooked projections to the surface to be cleaned would increase. That is, it is difficult to improve cleaning performance on hairs, etc. without increasing damage to the surface to be cleaned. In addition, it appears that the scraping sheet after collecting dust, such as hairs, is to be disposed of because of the difficulty in removing the collected dust from the sheet for reuse. Seeing that the scraping sheet has a complicated structure and is therefore costly, it is bad economy to dispose of the sheet after use.

SUMMARY OF THE INVENTION

An object of the present invention is to provide a cleaning sheet capable of removing fibrous dust, such as hairs and pieces of fluff, clinging to and entangled with a piled surface of a carpet, etc. with light force applied.

Another object of the present invention is to provide a cleaning sheet having excellent cleaning performance on the fibrous dust.

Still another object of the present invention is to provide a cleaning sheet having excellent cleaning performance without damaging a piled surface.

The above objects of the invention are accomplished by a cleaning sheet having a cleaning surface comprising a cleaning area for cleaning a piled surface and a low-friction area which adjoins the cleaning area, the cleaning area having a coefficient of static friction of 0.1 to 4.0 against wool press felt (JIS L3201 R33W).

The objects of the invention are also accomplished by a cleaning sheet having a scraping part and a dust-holding part, wherein the scraping part has on the surface thereof numerous fibers capable of edging into the pile of a piled surface and scraping fibrous dust present in the pile, the fibers mainly comprising fibers constituting air-laid nonwoven fabric, the dust-holding part is capable of holding the scraped fibrous dust.

BRIEF DESCRIPTION OF THE DRAWINGS

The present invention will be more particularly described with reference to the accompanying drawings, in which.

DETAILED DESCRIPTION OF THE PREFERRED EMBODIMENTS

Figure 1:
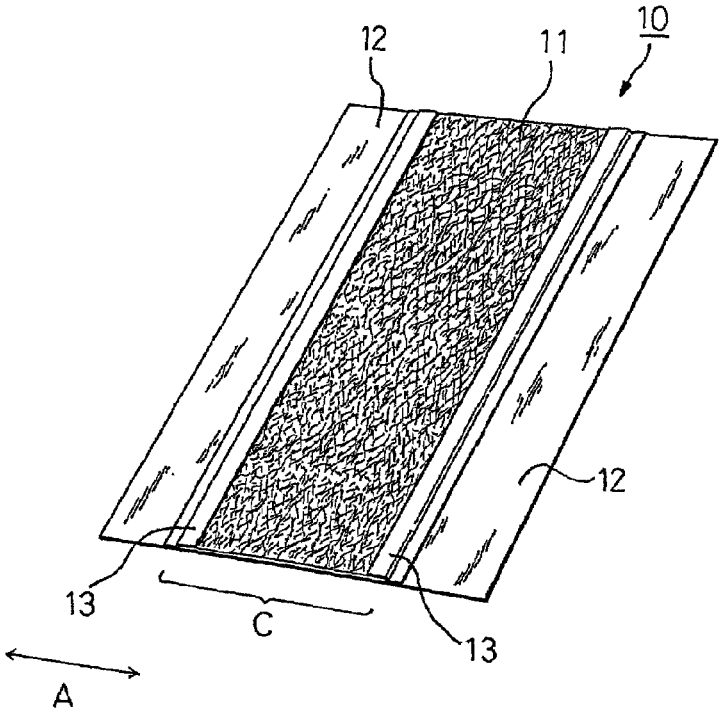
FIG. 1 is a perspective of a first embodiment of the cleaning sheet according to the present invention.

Preferred embodiments of the present invention will be described below. FIG. 1 shows a perspective of a first embodiment of the cleaning sheet according to the present invention. The cleaning sheet 10 shown in FIG. 1 is used to clean a piled surface. The cleaning sheet 10 has a cleaning surface C composed of a cleaning area for cleaning a piled surface and a low-friction area which adjoins the cleaning area and does not take part in cleaning a piled surface.

The cleaning area C has a coefficient of static friction as low as 0.1 to 4.0, preferably 0.3 to 3.5, still preferably 0.5 to 3.2 against wool press felt (JIS L3201 R33W). That is, the cleaning area C is not so scratchy. In cleaning a piled surface, the cleaning sheet 10 is prevented from catching on the pile and reducing the operating properties. If the static friction coefficient exceeds 4.0, friction is so high that operating properties are deteriorated. When, in particular, the cleaning sheet 10 is used as attached to a cleaning tool hereinafter described, a static friction coefficient more than 4.0 tends to result in detachment of the cleaning sheet during cleaning or considerable reduction of durability of the cleaning tool. If the static friction coefficient is less than 0.1, on the other hand, the cleaning surface C slides too smoothly on a surface to be cleaned, and it is difficult to rake up dust with the cleaning area. The low-friction area of the cleaning surface C makes a great contribution to provide the cleaning surface C with a static friction coefficient in the above-specified range. The low-friction area will be described later. English version of JIS (Japanese Industrial Standard) L3201 is incorporated herein by reference.

The static friction coefficient is measured as follows. A cleaning sheet is attached to a sliding piece, and a frictional force against wool press felt (JIS L3201 R33W) is measured with a tensile tester to obtain a coefficient of static friction. In detail, the middle portion (255 mm by 100 mm) of a cleaning sheet (255 mm by 205 mm) is attached to the base of a sliding piece (255 mm by 100 mm) with a both-sided adhesive tape. The sliding piece has a urethane cushioning layer on its base. The marginal portions of the cleaning sheet are turned around and fixed to the upper side of the sliding piece. A string hanging from the cross-head of the tensile tester is turned horizontally by means of a pulley, and its end is tied to the sliding piece having a total weight of 200 g±2 g (a normal force of 1.96 N+0.02 N) so that the sliding piece may move in the horizontal direction. The sliding piece is put on a wood press felt (JIS 13201 R33W, HW-1 available from AMBIC Co., Ltd.) having a thickness of 10 mm. The cross-head is lifted at a speed of 300 mm/min±10 mm/min, and the frictional force is measured. The frictional force increases linearly to reach the maximum load, which is taken as a static frictional force (Fs). The coefficient of static friction (μs) is obtained from Fs as follows.

$$\mu = Fs/Fp$$

wherein Fp is a normal force generated by the mass of the sliding piece (=1.96 N).

The cleaning area in the cleaning surface C is a rectangular first sheet 11. The first sheet 11 is disposed on a second sheet 12 larger than the first sheet 11. The second sheet 12 is to support the first sheet 11 and is not particularly limited in material and the like. The first sheet 11 has on its surface numerous fibers which are capable of edging into the pile of a piled surface. The numerous fibers function as a scraping part mainly comprising fibers constituting air-laid nonwoven fabric. The cleaning sheet 10 scrapes fibrous dust present in the pile by its scraping part mainly comprising the fibers constituting air-laid nonwoven fabric. The fibers have sufficient stiffness enough to scrape and rake up fibrous dust present in the pile. Such stiffness is obtained preferably by using fibers having a specific fineness and a specific length hereinafter described.

The term "air-laid nonwoven fabric" as used with respect to the first sheet 11 embraces two concepts; one is the surface portion of the first sheet 11 which constitutes the scraping part and directly contributes to the scraping function of the first sheet 11, and the other is the whole of the first sheet 11 inclusive of the surface portion. In what follows, the surface portion of the scraping part formed by an air-laying method will be referred to as an air-laid surface, and the first sheet 11 as a whole inclusive of the air-laid surface will be called air-laid nonwoven fabric.

An air-laying method generally comprises carrying disintegrated fibers in an air stream, allowing the fibers pass through a metal net or a screen having fine openings and accumulate on a wire mesh into a web, and binding the fibers at their intersections by a prescribed means such as thermal fusion or thermal adhesion. It is possible to introduce a binder component other than the constituent fiber either before or after the web formation and rendering the binder component adhesive by heating or a like means to bind the constituent fibers. In nature of the method, air-laid nonwoven fabric has countless tips of constituent fibers on its surface and in the vicinity of the surface. Therefore, air-laid nonwoven fabric can be used as at least the surface portion of the first sheet 11, whereby the fibers can enter into the pile to rake up dust therefrom. Since air-laid nonwoven fabric generally has the constituent fibers dispersed randomly in three dimensions, the cleaning performance does not vary according to the direction of cleaning operation, and even a narrow place can be cleaned easily.

It is particularly preferred that the air-laid surface be made up of fibers having a fineness of 23 to 200 dtex, especially 32 to 150 dtex. In this case, the fibers have sufficient stiffness for scraping fibrous dust from pile without damaging the pile and without producing an excessive frictional force in cleaning.

It is preferred for the constituent fibers of the air-laid surface to have a fiber length of 1 to 15 mm, particularly 2 to 10 mm so that at least the surface of the cleaning sheet 10 may have a vast number of fiber tips on at least its surface portion, that the fibers may be prevented from falling off during cleaning, and that web formation is easier.

The constituent fibers of the air-laid surface may be either crimped or non-crimped. The configuration of crimped fibers may be two-dimensional, such as a zig-zag shape, or three-dimensional, such as a spiral shape or an ohm shape.

The fiber of the air-laid surface comprises thermoplastic resins, such as polyolefin resins, e.g., polypropylene, polyethylene, and crystalline propylene copolymers comprising propylene and an α-olefin; polyamide resins, polyester resins, e.g., polyethylene terephthalate, polybutylene terephthalate, a low-melting copolyester comprising a diol and terephthalic acid/isophthalic acid, and a polyester elastomer; and fluororesins. The fiber may be fabricated of a single component selected from these resins or be composed of an appropriate combination of these resins, such as conjugate fibers. Configurations of the conjugate fibers include a side-by-side structure, a concentric core/sheath structure, an eccentric core/sheath structure, a multilayer structure having three or more layers, a hollow side-by-side structure, a hollow core/sheath structure, a sectional core/sheath structure, and an islands-in-sea structure, in which a low-melting resin forms at least part of the fiber surface. Rayon, pulp, etc. may be mixed into these fibers. It is also possible to form the air-laid surface solely of rayon, pulp, etc.

The air-laid nonwoven fabric preferably has a basis weight of 10 to 500 g/m$^2$, particularly 20 to 200 g/m$^2$. Air-laid nonwoven fabric having a basis weight of more than 500 g/m$^2$ is costly and unfit for high-speed production and therefore unsuited for application to disposable articles. Air-laid nonwoven fabric having a basis weight of less than 10 g/m$^2$ is difficult to make and tends to have difficulty in raking dust from pile.

Where the air-laid nonwoven fabric (i.e., the first sheet 11) is a composite of an air-laid surface and another sheet, the basis weight of the air-laid surface is decided by the strength of the sheets combined. When combined with a strong sheet, the air-laid surface is not destroyed even with a reduced basis weight. With no other sheet or with a sheet having a very small strength, the air-laid surface should have an increased basis weight to prevent destruction.

The air-laid nonwoven fabric preferably has a thickness of 0.2 to 5 mm, particularly 0.4 to 5 mm, especially 0.5 to 3.5 mm. Air-laid nonwoven fabric thicker than 5 mm tends to have low flexibility and is difficult to join to other sheets and unfit for high-speed production. Thicknesses less than 0.4 mm tend to have reduced dust collecting performance.

As stated above, while it is preferred that all the fibers constituting the air-laid nonwoven fabric making the scraping part of the cleaning sheet 10 have the above-specified fineness and length, fibers having a fineness of about 1 to 11 dtex and a fiber length of about 1 to 15 mm and making no contribution to cleaning a piled surface can be used in combination in a proportion of up to 50% by weight, desirably not more than 20% by weight.

The low-friction area, which is the other area making the cleaning surface C of the cleaning sheet 10, is made of a sheet 13 in the form of a strip. The sheet 13 is disposed on both sides of the cleaning surface C across the cleaning direction of the cleaning surface C. More specifically, the sheet 13 is disposed on both sides of the scraping part, i.e., at the front and the rear of the cleaning surface C, across the cleaning direction (the moving direction of the cleaning sheet 10 in cleaning operation). In this particular embodiment, the cleaning direction is the width direction of the first sheet 11, indicated by arrow A in FIG. 1, and the sheet 13 is arranged on both longitudinal sides of the first sheet 11. The sheet 13 extends from the longitudinal sides of the first sheet 11 to cover part of the second sheet 12. The sheet 13 is fixedly joined to the first sheet 11 and the second sheet 12 by a prescribed means, such as thermal fusion, adhesion with a hot-melt adhesive, adhesion with a both-sided adhesive tape, and needling with a sewing machine, etc. Adhesion with a sticky or adhesive substance, such as a hot-melt adhesive, or thermal fusion is preferably used for joining.

The shape and size of the sheet 13 are subject to variation according to the thickness and smoothness of the material making the sheet 13, the kinds of the first and second sheets, and the like. For example, where a wider cleaning area is desired, the area of the sheet 13 is made smaller, and the effect of reducing the frictional resistance is lessened as a result. On the contrary, widening the area of the sheet 13 results in reduced frictional resistance and, of necessity, a narrowed cleaning area.

The sheet 13 is preferably smooth such that the frictional force in cleaning may be reduced sufficiently. The sheet 13 includes plastic films and nonwoven fabrics. As long as sufficient reduction in frictional force can be accomplished, the film, etc. may have a non-smoothing finish such as embossing. The film, etc. may be reinforced by nonwoven fabric or other films.

Specifically, films commonly employed as packaging materials, such as those of thermoplastic resins, e.g., polyolefins, polyesters and polyamides, are suitable as the sheet 13. Thin metal films such as aluminum foil are also useful. Laminates of a thin metal film and a thermoplastic resin film can also be used. Sheeting having the surface (the surface coming into a surface to be cleaned) subjected to a treatment for reducing frictional resistance, such as silicone coating, is particularly preferred. Additionally, sheeting prepared by pressing nonwoven fabrics, such as melt-blown nonwoven fabric or spun-bonded nonwoven fabric, under a heat roll to smooth the surface is also serviceable.

For manifestation of sufficient cleaning performance and for reducing frictional resistance, it is preferred for the sheet 13 to have a thickness of 2 μm to 2 mm, particularly 5 μm to 100 μm, while depending on the kinds of the first and second sheets.

The static friction coefficient of the sheet 13, measured in accordance with the method previously described against felt, is preferably from 0.01 to 1.0, particularly from 0.01 to 0.5, so that the static friction coefficient of the cleaning surface C may fall within the above-recited range without excessively increasing the area ratio of the low-friction area.

The area ratio of the low-friction area in the cleaning surface C of the cleaning sheet 10 is preferably in a range of from 10 to 60%, particularly from 10 to 40%, for securing operating properties and effective use of the cleaning sheet.

Figure 2:
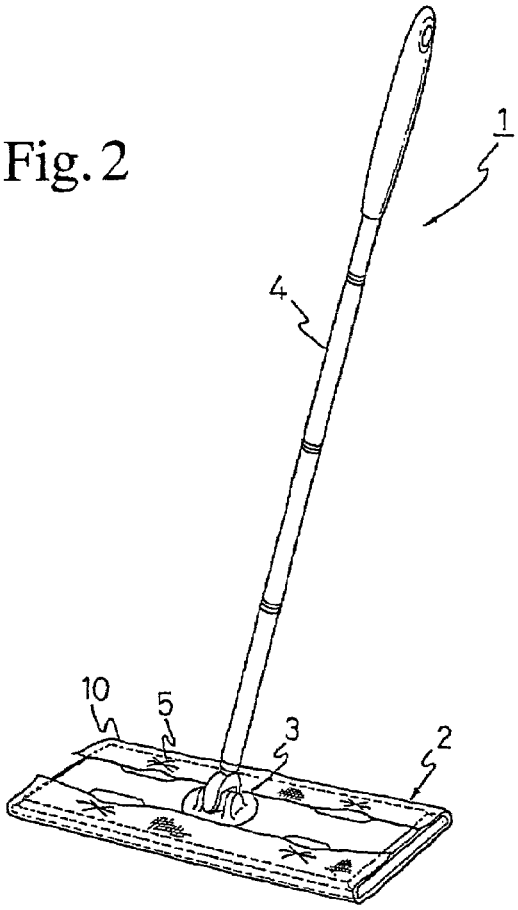
FIG. 2 is a perspective of a cleaning tool having the cleaning sheet of the present invention attached thereto.

According to the present embodiment, since the sheet 13 as a low-friction area exists on both sides of the cleaning surface C across the cleaning direction, the friction coefficient between the cleaning surface C and a piled surface during cleaning operation can be reduced. Therefore, a user can clean a piled surface with a little force while standing by use of a cleaning tool as shown in FIG. 2 having the cleaning sheet 10 attached to the head 2 thereof. The cleaning tool 1 comprises a flat head 2 having a flat base, to which the cleaning sheet 10 is attached, and a stick handle 4 connected to the head 2 via a universal joint 3. The cleaning sheet 10 is fixed to the head 2 by fitting the second sheet 12 into a plurality of flexible members 5 each having radial slits provided on the upper side of the head 2. The cleaning sheet 10 should be fixed to the flat base of the cleaning tool 1 in such a manner that the strips of the sheet 13 as a low-friction area come into contact with a surface to be cleaned.

Second and third embodiments of the present invention will be described by referring to FIGS. 3 and 4. The second and third embodiments will be explained with reference to the points different from the first one. The description on the first embodiment applies appropriately to what is not explained here. Members in FIGS. 3 and 4 which are common to FIGS. 1 and 2 are given the same numerals as used in FIGS. 1 and 2.

Figure 3:
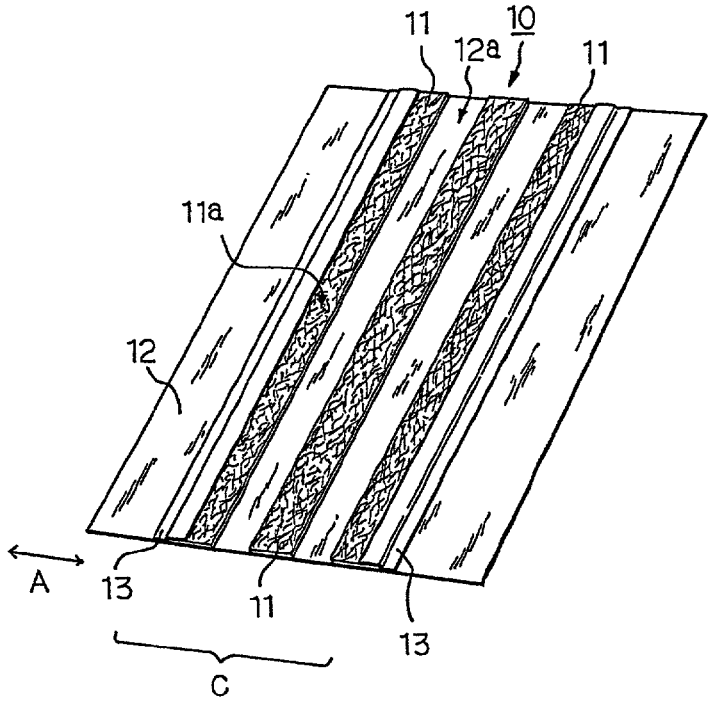
FIG. 3 is a perspective of a second embodiment of the cleaning sheet according to the present invention.

The cleaning sheet 10 according to the second embodiment which is shown in FIG. 3 has a cleaning surface C composed of a cleaning area and a low-friction area similarly to the first embodiment. The cleaning area is composed of scraping parts and dust-holding parts. In detail, the cleaning area is composed of a plurality of strips of a first sheet 11 and a single second sheet 12. The strips of the first sheet 11 have the same length and the same width or different widths. The second sheet 12 is a rectangle which is as long as the strips of the first sheet 11 and about 5 to 15 times as wide as the strip of the first sheet 11. The strips of the first sheet 11 which function as scraping parts are disposed on the second sheet 12 which functions as dust-holding parts. The cleaning sheet 10 also has a strip of a sheet 13 as a low-friction part on both sides of the cleaning surface C. The low-friction parts, the scraping parts and the dust-holding parts are regularly arranged within the cleaning surface C of the cleaning sheet 10.

The strips of the first sheet 11 are almost equally spaced with their longitudinal direction agreeing with that of the second sheet 12. The strips are fixed to the second sheet 12 by a prescribed means, such as thermal fusion, adhesion with a hot-melt adhesive, adhesion with a both-sided adhesive tape, and needling with a sewing machine. The area between the two strips of the first sheet 11 disposed on both sides of the first sheet functions as a cleaning surface C of the cleaning sheet 10.

The first sheet 11 is the same as used in the first embodiment. The second sheet 12 is different from that used in the first embodiment in that it should function as a dust-holding part which has higher ability to hold dust than the scraping part. That is, the cleaning sheet 10 has a scraping part and a dust-holding part. Unlike the scraping part, the dust-holding part is not required to have capability of scraping and raking dust. Scraped and raked fibrous dust caught up is held by the scraping part but mostly held by the dust-holding part having higher ability to hold dust. The dust-holding part is particularly contributory to holding scraped and collected fibrous dust finer than hairs, such as fluff. Thus, fibrous dust is effectively removed from the pile of a piled surface by the cleaning sheet 10 and held thereby.

The second sheet 12 in the cleaning sheet 10 shown in FIG. 3 serves as a dust-holding part as mentioned. The second sheet 12 is capable of holding fibrous dust raked up by the scraping part through a certain mechanism. The fibrous dust-holding mechanism includes (1) physical entanglement with fibers making up the sheet and (2) adhesion to a sticky or adhesive substance, such as a self-adhesive. In utilizing the dust-holding mechanism (1), spun-laced nonwoven fabric formed by physical entanglement of fibers is preferably used as the second sheet 12. Air-through nonwoven fabric having fibers bonded in a controlled manner is also useful. Spun-bonded nonwoven fabric having a large number of fibers contributory to the physical entanglement in which the individual fibers are composed of fine split fibers is also useful. In using the dust-holding mechanism (2), an adhesive sheet comprising a nonwoven fabric sheet, etc. having applied thereto a self-adhesive such as a hot-melt adhesive is used preferably.

The first sheet 11 is arranged on the second sheet 12 such that the scraping parts formed of the first sheet 11 and the dust-holding parts formed of the second sheet 12 are regularly arranged within the cleaning surface C of the cleaning sheet 10. The interval or the width of the strips of the first sheet 11 may be irregular such that the scraping parts and the dust-holding parts may be disposed irregularly. Having such a configuration, the cleaning sheet 10 exhibits satisfactory dust collecting performance against not only fibrous dust but other various kinds of dust.

For ensuring the capability of scraping dust and the capability of catching and holding the scraped dust, it is preferred that the scraping parts be the main area coming into contact with a surface to be cleaned, i.e., the contact of the dust-holding parts with the surface to be cleaned be less than that of the scraping parts. Such controlled contact can be achieved by, for example, providing a prescribed level difference between the scraping parts and the dust-holding parts so that the former may be higher than the latter. Specifically, such a level difference can be made by using a sheet having some thickness as the first sheet 11 forming the scraping parts. For example, use of a first sheet 11 having a thickness of 0.2 to 5 mm, particularly 0.4 to 5 mm, especially 0.5 to 3.5 mm, results in a sufficient level difference between the upper side 11*a* of the first sheet 11 and the upper side 12*a* of the second sheet 12 thereby to allow the scraping parts to come into main contact with a surface to be cleaned to a sufficient degree. The difference between the scraping parts and the dust-holding parts in degree of contact with a surface to be cleaned can also be provided by sticking the first sheet 11 functioning as scraping parts to the second sheet functioning as dust-holding parts or by reducing the contact area (exposed area) of the second sheet 12 functioning as dust-holding parts.

The low-friction area, which is still another area making the cleaning surface C of the cleaning sheet 10, is formed of a strip of a sheet 13. The sheet 13 is disposed on the side of the scraping parts disposed at the front and the rear of the cleaning surface C across the cleaning direction. Seeing that the cleaning direction in this embodiment is the width direction of the first sheet 11, indicated by arrow A in FIG. 3, a strip of the sheet 13 is arranged on the longitudinal side of the strip of the first sheet 11 provided at the front, and another strip of the sheet 13 on the longitudinal side of the strip of the first sheet 11 provided at the rear. Each strip of the sheet 13 does not cover the whole width of the strip of the first sheet 11 but only the outward side portion of the strip.

Figure 4:
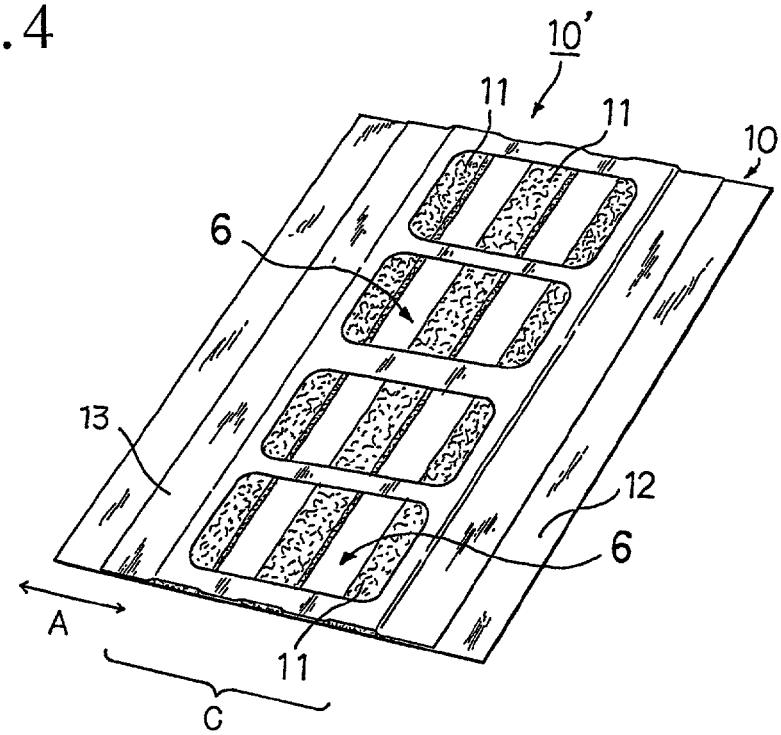
FIG. 4 is a perspective of a third embodiment of the cleaning sheet according to the present invention.

A third embodiment of the present invention is shown in FIG. 4. The low-friction area of the cleaning sheet 10 according to the third embodiment is formed of a sheet 13 having a number of openings 6. The openings 6 each have the shape of a rounded rectangle and are arrayed in a row across the cleaning direction A. Expressed in other words, the sheet 13 provides a low-friction area in a ladder-like pattern composed of a pair of band forms (like side rails of a ladder) which are disposed on both sides of the cleaning surface C across the cleaning direction A and a plurality of band forms (like rungs of a ladder) disposed between the side rails at a prescribed interval in parallel to the cleaning direction A. Thus, the scraping parts formed of the first sheet 11, the dust-holding parts formed of the second sheet 11, and the low-friction area formed of the sheet 13 are arranged in a regular configuration within the cleaning surface C. Similarly to the cleaning sheet of the first embodiment, the cleaning sheet 10 according to the third embodiment is capable of removing fibrous dust, such as hairs and fluff, entangled with a piled surface, such as a carpet, with light force applied.

The size of the openings is decided appropriately according to a desired area balance with the scraping and the dust-holding parts to be exposed. The total width of the openings 6 in the direction perpendicular to the cleaning direction A is preferably 5 to 95%, still preferably 40 to 80%, of the length of the cleaning surface C, and the length of each opening 6 in the cleaning direction is preferably 5 to 95%, still preferably 50 to 90%, of the width of the cleaning surface C.

For the purpose of preventing the cleaning sheet 10 from sliding out of position during cleaning operation or of reinforcing the sheet 13, the reverse side of the sheet 13, i.e., the side facing the first sheet 11 and the second sheet 12 may be lined with sheeting other than a smooth film, etc. used as a sheet 13, for example, nonwoven fabric such as spun-laced nonwoven fabric. In this case, the sheet 13 functioning as a low-friction area preferably has a thickness of 5 μm to 5 mm, particularly 5 μm to 500 μm, while varying depending on the thickness, etc. of the first and the second sheets 11 and 12. The thickness of the lining sheeting is not particularly limited unless attachment of the cleaning sheet to the cleaning tool is not interfered with.

Figure 5:
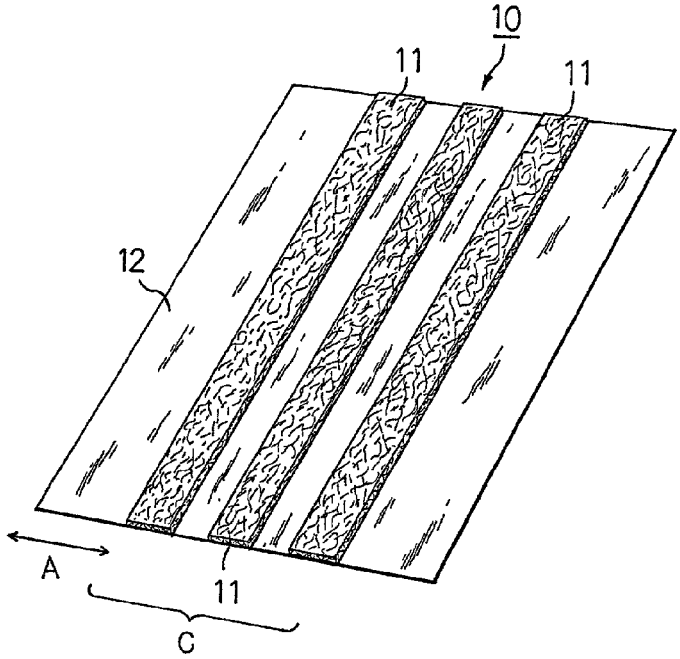
FIG. 5 is a perspective of another embodiment of the cleaning sheet according to the present invention.

Still another embodiment of the present invention will be described by referring to FIGS. 5 and 6. The cleaning sheet 10 shown in FIG. 5 is structurally similar to the cleaning sheet shown in FIG. 3 in that it has a cleaning surface C and that the cleaning surface has scraping parts and dust-holding parts. The difference between them resides in that the cleaning sheet 10 shown in FIG. 5 does not have a low-friction area on its cleaning surface C. The cleaning sheet 10 shown in FIG. 5 is used in combination with a cleaning kit 20 shown in FIG. 6. With this cleaning kit, a user can clean a piled surface more easily with a reduced frictional force while she or he is standing. The cleaning kit 20 is a combination of the cleaning tool 1 shown in FIG. 2 and a fitting sheet 7 having a plurality of openings 6 of prescribed shape which is detachably fitted over the flat base of the head 2 of the cleaning tool 1. At least the surface of the fitting sheet 7 which is brought into contact with a surface to be cleaned is made of smooth sheeting such as a plastic film so as to serve as the above-described low-friction area. The fitting sheet 7 has two rectangular openings of a size. The sheeting making the fitting sheet 7 can be of the same material as constitutes the above-described low-friction area. That is, the fitting sheet 7 functions as a low-friction area.

The size of the openings 6 is not particularly limited as far as part of the cleaning surface C is exposed. For example, the specifically recited size of the openings 6 of the sheet 13 used in the embodiment shown in FIG. 4 can apply here.

For the purpose of preventing the cleaning sheet 10 from sliding out of position during cleaning operation or of reinforcing the fitting sheet 7, the reverse side of the fitting sheet 7, i.e., the side facing the cleaning sheet 10 may be lined with sheeting other than a smooth film, etc. used as a fitting sheet 7, for example, nonwoven fabric such as spun-laced nonwoven fabric. In this case, the fitting sheet 7 preferably has a thickness of 5 μm to 5 mm, particularly 5 μm to 500 μm at the area which comes into contact with a surface to be cleaned and functions as a low-friction area, while varying depending on the kind, etc. of the cleaning sheet 10. The thickness of the lining sheeting is not particularly limited unless attachment of the fitting sheet 7 is not interfered with.

Figure 6:
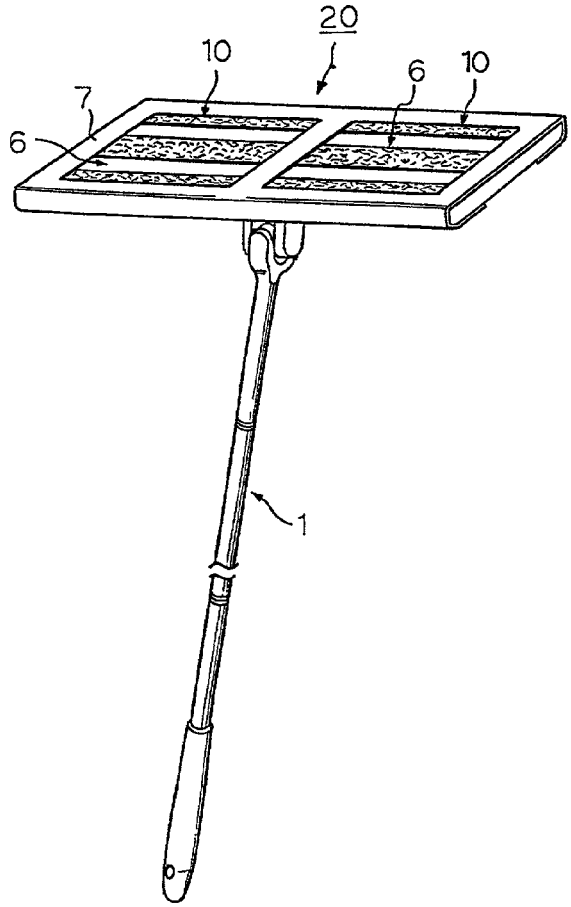
FIG. 6 is a perspective of a cleaning kit having the cleaning sheet shown in FIG. 5 attached thereto.

As shown in FIG. 6, the cleaning sheet 10 is used to clean a piled surface as it is held between the flat base of the head 2 and the fitting sheet 7 while partly exposing the first sheet 11 and the second sheet 12 (part of the scraping parts and part of the dust-holding parts) through the openings 6 of the fitting sheet 7. In this manner, the smoothness of the fitting sheet 7 reduces the frictional force in sliding operation, helping the cleaning tool easily slide on a piled surface.

The cleaning sheet according to the present invention is especially fit for cleaning piled surfaces (e.g., surfaces with a loop pile) of carpets, rugs, couches, automotive seats, and so forth. It is applicable as well to other types of surfaces including flat surfaces, such as flooring.

The present invention is not confined to the aforesaid embodiments. For example, while the cleaning sheets shown in FIGS. 1 and 3 have a low-friction area on both sides of the cleaning surface C across the cleaning direction A, a low-friction area may be provided on only one side of the cleaning surface C.

The sheet 13 used in the embodiment shown in FIG. 4 can be applied to the embodiment shown in FIG. 1.

While in the embodiments shown in FIGS. 1, 3 and 4 the low-friction area provided on both sides of the cleaning surface C is continuous in the direction perpendicular to the cleaning direction A, it may be provided discontinuously.

While in the embodiments of FIGS. 1, 3 and 4 the low-friction area is provided over the whole length of the cleaning surface C across the cleaning direction A, the length of the low-friction area may be shorter than the length of the cleaning surface C.

In place of air-laid nonwoven fabric used to serve as a cleaning area in the embodiments shown in FIGS. 1, 3, 4, and 5, it is possible to use the sheet proposed in JP-A-12-110057 (a composite nonwoven fabric composed of a net and a fiber web having thermally shrunken to make the net project over the web), sheeting with an angular pile, electrostatically flocked sheeting, or skeleton foam can be used.

The configuration pattern of the scraping parts, dust-holding parts and low-friction area on the cleaning surface C are not limited to those illustrated in FIGS. 3 and 4. Other various configurations are conceivable in conformity to the use of the cleaning sheet, the mode of using the cleaning sheet, and the like.

The cleaning sheet of the present invention can be impregnated with a detergent, etc. by soaking or spraying to improve the cleaning effect or to add supplementary effects such as deodorizing effect and an antimicrobial effect. Otherwise, it is effective to spray a liquid detergent, etc. onto a surface to be cleaned before wiping with the cleaning sheet of the present invention.

The cleaning sheet of the present invention is conveniently used as attached to not only the cleaning tool shown in FIGS. 2 and 6 but a handy cleaning tool, for example, the cleaning tool shown in FIG. 4 of U.S. Pat. No. 5,953,784, which is incorporated herein by reference.

In the cleaning sheets shown in FIGS. 1, 3, 4, and 5, the first sheet 11 serving for dust scraping and the second sheet 12 serving for dust holding may be fabricated integrally by, for example, integrally forming air-laid nonwoven fabric in a prescribed pattern to form scraping parts on spun-laced nonwoven fabric serving as dust-holding parts.

While the cleaning sheets shown in FIGS. 3 to 5 have a level difference between the upper side 11*a* of the first sheet 11 and the upper side 12*a* of the second sheet 12, the upper side of the first sheet 11 and the upper side of the second sheet 12 may be almost even with no such a level difference.

The cleaning sheets shown in FIGS. 3 to 5 may be prepared by sticking strips of the first sheet 11 and strips of the second sheet 12 on a third sheet wider than the total width of these strips. The strips can be stuck by the same joining means as described above. In a modification, strips of the first sheet 11 and strips of the second sheet 12 may be connected alternately using a plurality of strips of an adhesive sheet as a third sheet to make up a single sheet. It is possible to use the sheet 13 forming the low-friction area as the third sheet.

The present invention will now be illustrated in greater detail with reference to Examples. The following Examples are presented for illustrative purposes and should not be construed as being limiting. Unless otherwise noted, all the parts and percents are by weight.

EXAMPLE 1

A mixture of 90% of very thick core/sheath type conjugate fiber made of polypropylene as a core and polyethylene as a sheath and having a length of 5 mm and a fineness of 72 dtex (65 denier) and 10% of core/sheath type conjugate fiber made of polypropylene as a core and polyethylene as a sheath and having a length of 5 mm and a fineness of 1.7 dtex (1.5 denier) was accumulated by an air-laying method on spun-bonded nonwoven fabric of core/sheath type conjugate fiber made of polypropylene as a core and polyethylene as a sheath and having a basis weight of 20 g/m$^2$ to form a web having a basis weight of 50 g/m$^2$. Hot air was blown to thermally bond the fibers constituting the web to one another and also to the spun-bonded nonwoven fabric to obtain air-laid nonwoven fabric having a basis weight of 70 g/m$^2$. The air-laid nonwoven fabric was cut to a width of 100 mm in the cross direction of the stock and a length of 255 mm in the machine direction of the stock.

The cut sheet of the air-laid nonwoven fabric was stuck to the middle of a cut piece (205 mm by 255 mm) of spun-laced nonwoven fabric (Floor Quickle Dry Sheet, available from Kao Corp., hereinafter referred to as Dry Sheet) by means of a both-sided adhesive tape (NITTO No. 500, available from Nitto Denko Corp.) with the very thick fiber-containing side up.

Separately, a polypropylene film about 150 mm wide, about 255 mm long and about 60 μm thick was prepared. The film had a static friction coefficient of 0.52 as measured according to the above-described method. Four openings 47.5 mm wide and 80 mm long were cut in a row in the film along the longitudinal direction of the film, with the width direction of the openings corresponding to the longitudinal direction of the film. The four openings were spaced at an interval of 10 mm, 30 mm, and 10 mm. The distance from each short side edge of the rectangular film to the nearest opening was 7.5 mm, and the distance from each long side edge of the film to each opening was 35 mm.

The film having the openings was stuck to the air-laid nonwoven fabric by means of the same both-sided adhesive tape as used above to prepare a cleaning sheet.

EXAMPLE 2

A cleaning sheet was prepared in the same manner as in Example 1, except for replacing the polypropylene film having openings with three strips of an about 60 μm thick polypropylene film (static friction coefficient: 0.52) each having a width of 15 mm and a length of 255 mm as follows. One of the long side edges of the air-laid nonwoven fabric (100 mm by 255 mm) being taken as a base (0 mm), the first strip was stuck on the area 0 to 15 mm wide of the base, the second one on the area 42.5 to 57.5 mm wide of the base, and the third one on the area 85 to 100 mm wide of the base.

EXAMPLE 3

A mixture of 90% of very thick core/sheath type conjugate fiber made of polypropylene as a core and polyethylene as a sheath and having a length of 5 mm and a fineness of 72 dtex (65 denier) and 10% of core/sheath type conjugate fiber made of polypropylene as a core and polyethylene as a sheath and having a length of 5 mm and a fineness of 1.7 dtex (1.5 denier) was accumulated by an air-laying method on spun-bonded nonwoven fabric of core/sheath type conjugate fiber made of polypropylene as a core and polyethylene as a sheath and having a basis weight of 20 g/m$^2$ to form a web having a basis weight of 50 g/m$^2$. Hot air was blown to thermally bond the fibers constituting the web to one another and also to the spun-bonded nonwoven fabric to obtain air-laid nonwoven fabric having a basis weight of 70 g/m$^2$.

Two strips 25 mm wide and 255 mm long (hereinafter referred to as first strips) and one strip 20 mm wide and 255 mm long (hereinafter referred to as second strip) were cut out of the resulting air-laid nonwoven fabric, with the width direction of the strips corresponding to the machine direction of the fabric, and the longitudinal direction of the strips corresponding to the cross direction of the fabric. The thickness of the first strips and the second strip was 1.2 mm.

The two first strips and the second strip of the air-laid nonwoven fabric were stuck to predetermined positions of a cut piece (205 mm by 255 mm) of spun-laced nonwoven fabric (Floor Quickle Dry Sheet, available from Kao Corp.) by means of a both-sided adhesive tape (NITTO No. 500, available from Nitto Denko Corp.) with the very thick fiber-containing side up. The three strips were positioned as follows. Consider a 100 mm wide and 255 mm long imaginary rectangle the long sides of which are parallel to, and equidistant from, the long sides of the Dry Sheet, and the short side edges of which are even with the short side edges of the Dry Sheet. In other words, the imaginary rectangle is in the exact middle of the width direction of the Dry Sheet. Take one of the long sides of the imaginary rectangle as a base (0 mm). The three strips were arranged within this imaginary rectangle. One of the first strips (width: 25 mm) was placed on the area 0 to 25 mm wide of the base, and the other one on the area 75 to 100 mm wide of the base. The second strip (width: 20 mm) was on the area 40 to 60 mm wide of the base.

Two strips of a polypropylene film (thickness: about 60 μm; static friction coefficient: 0.52) each having a width of 30 mm and a length of 255 mm were prepared. The strip was stuck on each border between each first strip and the Dry Sheet with a 15 mm wide overlap on the first strip. The cleaning sheet thus obtained had the configuration shown in FIG. 3.

COMPARATIVE EXAMPLE 1

A cleaning sheet was prepared by the same manner as in Example 1, except that the polypropylene film having openings was not used.

COMPARATIVE EXAMPLE 2

A cleaning sheet was prepared by the same manner as in Example 1, except for replacing the polypropylene film having openings with two strips of an about 60 μm thick polypropylene film (static friction coefficient: 0.52) each having a width of 15 mm and a length of 255 mm as follows. One of the long side edges of the air-laid nonwoven fabric (100 mm by 255 mm) being taken as a base (0 mm), the first strip was stuck on the area 25 to 40 mm wide of the base, the second one on the area 60 to 75 mm wide of the base.

Performance Evaluation:

The static friction coefficient of the cleaning surface of the cleaning sheets obtained in Examples and Comparative Examples was measured by the above-described method. Further, the cleaning sheets were evaluated for hair collecting performance, operating properties in cleaning, and fluff collecting performance in accordance with the following test methods. The results obtained are shown in Table 1 below. The area ratio of the low-friction area in the cleaning surface is also shown in Table 1.

1) Hair Collecting Performance

The cleaning sheet was attached to a cleaning tool illustrated in FIG. 2 (Quickle Wiper, supplied by Kao Corp.). The head of this cleaning tool was about 100 mm wide and about 255 mm long at its base and had relatively small unevenness on its base.

A commercially available carpet with a cut pile (MARIPOZA, supplied by Suminoe Textile Co., Ltd.; material: 100% polyester; pile length: 7 mm; density: gauge 1/10; stitch: 55/10 cm) and a commercially available carpet with a loop pile (TUFTY, supplied by Suminoe Textile Co., Ltd.; material: 100% nylon; pile length: 4 mm; density: gauge 1/10; stitch: 36/10 cm) were used as a piled surface. Ten human hairs of 10 cm in length were scattered over each carpet within an area of about 50 cm by about 80 cm. The surface of the carpet having the hairs scattered on was given four double strokes with the cleaning tool. Without removing the hairs caught on the cleaning sheet, scattering of hairs and the cleaning operation were repeated three times. The percentage of the number of the hairs finally held on the cleaning surface to the total number of scattered hairs (40) was calculated as a measure of hair collecting performance (%). The carpet with a cut pile was cleaned in two directions, with the pile and against the pile.

2) Operating Properties in Cleaning

The operating properties of the cleaning tool with the cleaning sheet attached in the above-described cleaning operation were ranked as follows.

A The cleaning operation was carried out with no substantial problem.

B Although the cleaning tool felt resistant to sliding on the carpet, the cleaning operation was carried out.

C The cleaning tool felt too resistant against sliding on the carpet to carry out cleaning.

3) Fluff Collecting Performance

A commercially available carpet with a cut pile (MARIPOZA, supplied by Suminoe Textile Co., Ltd.; material: 100% polyester; pile length: 7 mm; density: gauge 1/10; stitch: 55/10 cm) was used as a piled surface to be cleaned. Commercially available 100% acrylic knitting yam weighing 0.5 g was cut into pieces of 1 to 3 mm long and scattered on the carpet within an area of about 50 cm by about 1 m. The area of the carpet having the yarn pieces scattered on was given 30 double strokes with the cleaning tool having the cleaning sheet attached thereto. The cleaning sheet was detached from the cleaning tool and weighed. Subtraction of the weight of the cleaning sheet measured before attachment from the weight of the cleaning sheet after the cleaning gave the weight (g) of the fluff collected. The percentage of the weight of the fluff collected to the weight of the scattered fluff (0.5 g) was calculated as a collecting ratio (%) [collecting ratio (%) =weight of collected dust (g)/0.5 g×100].

TABLE 1

| No. | Static Friction Coefficient | Area Ratio of Low-Friction Area (%) | Hair Collecting Performance (%) Cut Pile With Pile | Cut Pile Against Pile | Loop Pile | Operating Properties Cut Pile With Pile | Cut Pile Against Pile | Loop Pile | Performance Cut Pile With Pile |
|---|---|---|---|---|---|---|---|---|---|
| Example 1 | 2.8 | 39 | 90 | 90 | 85 | A | A | A | 30% |
| Example 2 | 3.1 | 45 | 90 | 90 | 85 | A | A | A | 32% |
| Example 3 | 2.4 | 30 | 90 | 90 | 85 | A | A | A | 58% |
| Comparative Example 1 | 4.5 | 0 | 90 | 0 | 0 | A | C | C | — |
| Comparative Example 2 | 4.1 | 30 | 90 | 78 | 73 | A | B | B | — |

As is apparent from the results in Table 1, the cleaning sheets of the present invention exhibit high performance in removing hairs from a piled surface. It is also seen that cleaning a piled surface with the cleaning sheet of the present invention can be carried out easily with light force applied. In contrast, the cleaning sheets of Comparative Examples show poor performance in removing hairs, and exhibit large friction force against the carpet, resulting in poor cleaning operation. In particular, very large friction force was observed in Comparative Examples when the carpet was cleaned in the direction against the pile.

EXAMPLE 4

A first web having a basis weight of 40 g/m$^2$ was made of core/sheath type conjugate fiber comprising polypropylene as a core and polyethylene as a sheath and having a fiber length of 5 mm and a fineness of 6.7 dtex (6 denier) by an air-laying method. A second web having a basis weight of 80 g/m$^2$ was air-laid on the first web using core/sheath type conjugate fiber comprising polypropylene as a core and polyethylene as a sheath and having a length of 5 mm and a fineness of 72 dtex (65 denier). Hot air was blown to the composite web to thermally fuse the constituent fibers with one another to obtain air-laid nonwoven fabric having a basis weight of 120 g/m$^2$.

Two strips 25 mm wide and 260 mm long (hereinafter referred to as first strips) and one strip 20 mm wide and 260 mm long (hereinafter referred to as a second strip) were cut out of the resulting air-laid nonwoven fabric, with the width direction of the strips corresponding to the machine direction of the fabric, and the longitudinal direction of the strips corresponding to the cross direction of the fabric. The thickness of the first strips and the second strip was 3.3 mm.

A cut piece (100 mm by 260 mm) of spun-laced nonwoven fabric (Floor Quickle Dry Sheet, available from Kao Corp.) was prepared. The two first strips of the air-laid nonwoven fabric were each stuck to the long side area of the Dry Sheet with the second web side up and with the long side edge of the former being even with that of the latter by means of a both-sided adhesive tape (NITTO No. 500, available from Nitto Denko Corp.). The second strip (width: 20 mm) was stuck to the area of the Dry Sheet 40 to 60 mm wide of the long side thereof with the second web side up by means of the same adhesive tape. The resulting cleaning sheet is of the type shown in FIG. 5, the side having the strips of the air-laid nonwoven fabric serving as a cleaning surface.

EXAMPLE 5

A cleaning sheet of the type shown in FIG. 5 was prepared in the same manner as in Example 4, except for replacing the composite air-laid nonwoven fabric as used in Example 4 with air-laid nonwoven fabric having a basis weight of 70 g/m$^2$, made of core/sheath type conjugate fiber comprising polypropylene as a core and polyethylene as a sheath, and having a fiber length of 5 mm and a fineness of 35 dtex (32 denier).

COMPARATIVE EXAMPLE 3

A web having a basis weight of 70 g/m$^2$ was fabricated of core/sheath type conjugate fiber made of polypropylene as a core and polyethylene as a sheath and having a length of 5 mm and a fineness of 20 dtex (18 denier) by an air-laying method. Hot air was blown to the web to thermally fuse the constituent fibers to obtain air-laid nonwoven fabric, which was cut to a width of about 100 mm in the machine direction and a length of about 260 mm in the cross direction to prepare a cleaning sheet.

COMPARATIVE EXAMPLE 4

A mixture of 50% of polyethylene terephthalate fiber having a fiber length of 51 mm and a fineness of 1.7 dtex (1.5 denier) and 50% of rayon fiber having a fiber length of 51 mm and a fineness of 1.7 dtex (1.5 denier) was carded by means of a semirandom card to obtain a first web having a basis weight of 30 g/m$^2$.

A mixture of 50% of thermally shrinkable fiber of an ethylene-propylene random copolymer having a fiber length of 51 mm and a fineness of 2.2 dtex (2.0 denier) and 50% of rayon fiber having a fiber length of 51 mm and a fineness of 1.7 dtex (1.5 denier) was carded by means of a semirandom card to obtain a second web having a basis weight of 15 g/m$^2$.

A net made of polypropylene strands having a diameter of 0.2 mm in a lattice pattern having 0.95 mm-side square openings was superposed on the first web, and the 5 second web was superposed on the net. Water jets having a water pressure of 2 MPa spouted from a nozzle having orifices of 0.1 mm in diameter at 0.6 mm intervals were applied to the first web side to entangle the constituent fibers of the first and second webs with the net. The resulting spun-laced nonwoven fabric was treated at 135° C. at an overfeed rate of 140% to shrink the thermally shrinkable fiber in the fabric, whereupon wrinkles were produced on the first web side. Since the polypropylene net underwent substantially no shrinkage, projections were formed in the thickness direction of the nonwoven fabric towards both web sides. The resulting composite sheet was cut into a sheet with a width of about 100 mm and a length of about 260 mm, the length of the cut sheet being in the machine direction of the stock sheet. The first web side of the cut sheet was used as a cleaning surface.

EXAMPLE 6

A mixture of 90% of very thick core/sheath type conjugate fiber made of polypropylene as a core and polyethylene as a sheath and having a fiber length of 5 mm and a fineness of 72 dtex (65 denier) and 10% of core/sheath type conjugate fiber made 20 of polypropylene as a core and polyethylene as a sheath and having a length of 5 mm and a fineness of 1.7 dtex (1.5 denier) was accumulated by an air-laying method on spun-bonded nonwoven fabric of core/sheath type conjugate fiber made of polypropylene as a core and polyethylene as a sheath and having a basis weight of 20 g/m$^2$ to form a web having a basis weight of 50 g/m$^2$. Hot air was blown to 25 thermally fuse the fibers constituting the web to one another and also to the spun-bonded nonwoven fabric to obtain air-laid nonwoven fabric having a basis weight of 70 g/m$^2$.

Two first strips 25 mm wide and 260 mm long and one second strip 20 mm wide and 260 mm long were cut out of the resulting air-laid nonwoven fabric, with the width direction of the strips corresponding to the machine direction of the stock. The thickness of the first strips and the second strip was 1.2 mm.

The two first strips and the second strip of the air-laid nonwoven fabric were stuck to predetermined positions of a cut piece (ca. 205 mm by ca. 260 mm) of spun-laced nonwoven fabric (Floor Quickle Dry Sheet, available from Kao Corp.) by means of a both-sided adhesive tape (NITTO No. 500, available from Nitto Denko Corp.) with the very thick fiber-containing side up. The three strips were arranged within an imaginary rectangle 100 mm wide and 260 mm long drawn in the exact middle of the Dry Sheet in the same manner as in Example 5. Taking one of the long sides of the imaginary rectangle as a base (0 mm), one of the first strips (width: 25 mm) was placed on the area 0 to 25 mm wide of the base, and the other one on the area 75 to 100 mm wide of the base. The second strip (width: 20 mm) was positioned on the area 40 to 60 mm wide of the base.

A polypropylene film having a width of about 150 mm, a length of about 260 mm and a thickness of about 60 μm was prepared. Openings were made in the film. The configuration of the openings was the same as those made in the fitting sheet used in evaluation of hair collecting performance hereinafter described.

Four pieces of both-sided adhesive tape made of paper, each having a width of 10 mm and a length of 15 mm, were each stuck to a rectangular area of the Dry Sheet, which area was outside the above-described imaginary rectangle, one of the short sides of which was in contact with the imaginary rectangle, and one of the long sides of which was even with the short side of the Dry Sheet. The polypropylene film was adhered to the four pieces of the both-sided adhesive tape in such a manner that the center line of the film in the width direction was in agreement with the center line of the Dry Sheet in the width direction (i.e., the center line of the imaginary rectangle in the width direction) and that the slipperier side of the film faced the strips. The cleaning sheet thus prepared was of the type shown in FIG. 4.

Performance Evaluation:

The cleaning sheets obtained in Examples 4 to 6 and Comparative Examples 3 and 4 were evaluated for hair collecting performance and fluffy dust collecting performance in accordance with the following test methods. The results obtained are shown in Table 2 below.

1) Hair Collecting Performance

The cleaning sheet was attached to a cleaning tool illustrated in FIG. 2 (Quickle Wiper, supplied by Kao Corp.). The head of this cleaning tool was about 100 mm wide and about 260 mm long at its base and had relatively small unevenness on its base.

In testing the cleaning sheets of Examples 4 and 5 and Comparative Examples 3 and 4, a fitting sheet described below was fitted over the cleaning sheet. The cleaning sheet of Example 6 was tested without the fitting sheet.

a) Preparation of Fitting Sheet

A about 150 mm wide, about 260 mm long, and about 30 μm thick polyethylene terephthalate (PET) film having a release coat commonly used for self-adhesives on one side thereof was prepared. The PET film and about 210 mm wide and about 260 mm long spun-laced nonwoven fabric (Floor Quickie Dry Sheet, available from Kao Corp.) were joined in such a manner that the release-finished side of the film faced outside and that the centers of the film and the nonwoven fabric agreed with each other. A commercially available double-sided adhesive tape made of paper was used for joining.

Four openings 47.5 mm wide and 80 mm long were cut in the resulting composite sheet in a row along the longitudinal direction of the composite sheet (the longitudinal direction of the head), with the width direction of the openings corresponding to the longitudinal direction of the composite sheet (longitudinal direction of the head). The four openings were spaced at an interval of 10 mm, 30 mm, and 10 mm. The distance from each long side edge of the composite sheet to each opening was 35 mm.

b) Measurement of Number of Hairs Collected

A commercially available carpet with a cut pile (MARIPOZA, supplied by Suminoe Textile Co., Ltd.; material: 100% polyester) was used as a piled surface to be cleaned.

Ten human hairs of 100 mm in length were scattered on the carpet within an area of about 500 mm by about 800 mm. The surface of the carpet having the hairs scattered on was given four double strokes with the cleaning tool having the cleaning sheet (and the fitting sheet where needed) attached thereto. Without removing the hairs caught on the cleaning sheet, scattering of hairs and the cleaning operation were repeated three times. The number of the hairs finally held on the cleaning surface out of the total number of hairs scattered (i.e., 40 hairs) was taken as a measure of hair collecting performance.

2) Fluff Collecting Performance

A carpet with a cut pile made of 85% acrylic fiber and 15% nylon fiber (San Harmony, available from Sangetsu Co., Ltd.) was used as a piled surface to be cleaned. Commercially available 100% acrylic knitting yarn weighing 0.5 g was cut into pieces of 1 to 3 mm long and scattered on the carpet within an area of about 50 cm by about 1 m. The area of the carpet having the yam pieces scattered on was given 30 double strokes with the cleaning tool having the cleaning sheet (and the fitting sheet where needed) attached thereto. The cleaning sheet was detached from the cleaning tool and weighed. Subtraction of the weight of the cleaning sheet measured before attachment from the weight of the cleaning sheet after the cleaning gave the weight (g) of the fluff collected. The percentage of the weight of the fluff collected to the weight of the scattered fluff (0.5 g) was calculated as a collecting ratio (%) [collecting ratio (%)=weight of collected dust (g)/0.5 g×100]. After the cleaning operation, the carpet was inspected for formation of balls of fluff with the naked eye. The degree of formation of fluff balls was ranked as follows.

A No formation
B Ready to form
C Slight formation
D Considerable formation

TABLE 2

| | | Fluff Collecting Performance | |
|---|---|---|---|
| | Hair Collecting Performance | Collecting Ratio (%) | Formation of Fluff Balls |
| Example 4 | 34/40 | 28 | B–C |
| Example 5 | 36/40 | 30 | B–C |
| Example 6 | 36/40 | 47 | A |
| Comparative Example 3 | 20/40 | 23 | C |
| Comparative Example 4 | 9/40 | 9 | C |

As can be seen from the results in Table 2, the cleaning sheets of Examples 4 to 6 according to the present invention exhibit high performance of removing hairs from a piled surface and practically sufficient performance in collecting and catching fluffy dust. The cleaning sheets of Comparative Examples cannot be seen as satisfactory in both performances. It has now understood that the cleaning sheet of the present invention which has a scraping part comprising an air-laid surface and a dust-holding part is sufficiently effective in actual use.

As having been fully described, the present invention provides a cleaning sheet which has excellent cleaning performance against fibrous dust, such as hairs and fluff, entangled with a piled surface, such as a carpet, and capable of removing such fibrous dust with light force applied. The cleaning sheet does no damage to the pile of a piled surface. A user can clean a piled surface easily with the cleaning sheet while standing.

The invention having been thus described, it will be obvious that the same may be varied in many ways. Such variations are not to be regarded as a departure from the spirit and scope of the invention, and all such modifications we would be obvious to one skilled in the art are intended to be included within the scope of the following claims.

This application claims the priority of Japanese Patent Application Nos. 2000-314336 filed Oct. 13, 2000 and 2001-212739 filed Jul. 12, 2001, which are incorporated herein by reference.

What is claimed is:

1. A cleaning sheet having a cleaning surface comprising a cleaning area for cleaning a piled surface and a low-friction area which adjoins said cleaning area, wherein said cleaning area has a first sheet as a scraping part and second sheet as a dust-holding part, wherein the first and second sheets extend in the same direction;

said first sheet is an air-laid nonwoven fabric comprising at least one thermoplastic resin selected from the group consisting of a polyolefin, polyamide, polyester and a fluororesin, and the air-laid surface comprises numerous fibers having a fineness of 23 to 200 dtex;

said second sheet comprises spun-laced, air-through or spun-bonded nonwoven fabric;

said scraping part of the first sheet having on the surface thereof numerous fibers that edges into the pile of a piled surface and scrapes fibrous dust present in said pile, said fibers mainly comprising fibers constituting the air-laid nonwoven fabric, and said dust-holding part of the second sheet holds the scraped fibrous dust by having the fibrous dust physically entangled therewith;

wherein said cleaning area having a coefficient of static friction of 0.1 to 4.0 against wool press felt (JIS L3201 R33W), wherein said cleaning area contains the air-laid nonwoven fabric, and said low-friction area comprises a film or a nonwoven fabric, and wherein said low-friction area has a coefficient of static friction of 0.01 to 1.0 against wool press felt (JIS L3201 R33W).

2. The cleaning sheet according to claim 1, wherein the area ratio of said low-friction area to said cleaning surface is 10 to 60%.

3. The cleaning sheet according to claim 1, wherein said low-friction area is disposed on one side of said cleaning surface across the cleaning direction of said cleaning surface.

4. The cleaning sheet according to claim 3, wherein said low-friction area is disposed on both sides of said cleaning surface across the cleaning direction of said cleaning surface.

5. The cleaning sheet according to claim 1, wherein said first sheet is disposed on said second sheet.

* * * * *